US007693454B2

(12) United States Patent
Azuma et al.

(10) Patent No.: US 7,693,454 B2
(45) Date of Patent: Apr. 6, 2010

(54) IMAGE FORMING APPARATUS

(75) Inventors: Jun Azuma, Osaka (JP); Junichiro Otsubo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 412 days.

(21) Appl. No.: 11/717,190

(22) Filed: Mar. 13, 2007

(65) Prior Publication Data

US 2007/0217821 A1 Sep. 20, 2007

(30) Foreign Application Priority Data

Mar. 14, 2006 (JP) ..... 2006-068681

(51) Int. Cl.
*G03G 15/00* (2006.01)

(52) U.S. Cl. ..... 399/159; 399/164

(58) Field of Classification Search ..... 399/159, 399/164; 430/63

See application file for complete search history.

(56) References Cited

U.S. PATENT DOCUMENTS

| | | | | |
|---|---|---|---|---|
| 4,518,669 | A * | 5/1985 | Yashiki | 430/57.1 |
| 2001/0044063 | A1* | 11/2001 | Hamaguchi et al. | 430/63 |
| 2005/0019683 | A1* | 1/2005 | Tomoyori et al. | 430/63 |

FOREIGN PATENT DOCUMENTS

| | | |
|---|---|---|
| JP | 52-025638 | 2/1977 |
| JP | 56-052757 | 5/1981 |
| JP | 63-018185 | 4/1988 |
| JP | 02-181158 | 7/1990 |
| JP | 04-229872 | 8/1992 |
| JP | 08-328283 | 12/1996 |
| JP | 09-152731 | 6/1997 |
| JP | 09-258469 | 10/1997 |
| JP | 2002-236381 | 8/2002 |

* cited by examiner

*Primary Examiner*—John L Goodrow
(74) *Attorney, Agent, or Firm*—Clark & Brody

(57) ABSTRACT

Disclosed is an image forming apparatus composed of a combination of multi-layered electrophotographic photoreceptor wherein an undercoat layer is made of at least fine titanium oxide particles and a binder resin and has a thickness of 3 μm or less and the fine titanium oxide particles are surface treated with alumina and silica and have a number average primary particle size of 20 nm or less, and exposing means by LED exposure. Thus, an electrophotographic photoreceptor having good balance between dispersibility of titanium oxide and electrical insulation properties is obtained and image fog does not occur under high temperature and high humidity environment and also excellent image quality can be maintained during continuous printing under low temperature and low humidity environment.

14 Claims, 1 Drawing Sheet

IMAGE FORMING APPARATUS

Priority is claimed to Japanese Patent Application No. 2006-068681 filed on Mar. 14, 2006, the disclosure of which is incorporated by reference in its entirety.

BACKGROUND OF THE INVENTION

1. Field of the Invention

The present invention relates to an image forming apparatus such as copying machine or printer, which is loaded with a multi-layered electrophotographic photoreceptor having an undercoat layer.

2. Description of Related Art

With the progress of the development, conventionally used inorganic materials typified by amorphous selenium and amorphous silicone have recently been replaced by organic photoconductive materials. An electrophotographic photoreceptor using an organic photoconductive material is slightly inferior in sensitivity, durability and stability in the environment, but has a lot of merits in toxicity, cost and degree of freedom of material design as compared with the inorganic material.

In the electrophotographic photoreceptor, there is widely used an organic photoreceptor comprising a charge generating material which generates charges upon irradiation with light, a charge transporting material which transports charges generated, and a binder resin constituting a layer in which these substances are dispersed. Commonly, the organic photoreceptor is roughly classified into a photoreceptor comprising a single-layered photosensitive layer wherein a charge generating material and a charge transporting material are contained in the same layer, and a photoreceptor comprising a multi-layered photosensitive layer formed by laminating a charge generating layer containing a charge generating material with a charge transporting layer containing a charge transporting material.

A multi-layered photoreceptor obtained by directly forming a multi-layered photosensitive layer on a conductive substrate through coating is likely to be influenced by the surface of a conductive substrate and it is difficult to form a layer uniformly and homogeneously and therefore thickness unevenness occurs, thus causing various image defects and density unevenness. Also, since a layer containing a charge generating substance is directly contacted with a conductive substrate, when electric field is applied by charging, the charge generating substance partially generates charges, and thus the potential locally decreases at the position where the charge generating substance exists in the vicinity, and problems such as blank paper and fog at the gray portion occur in the reversal development. These problems conspicuously occur under high temperature and high humidity environment.

It is known to be effective to provide a resin layer, which is referred to as an undercoat layer or an intermediate layer, between a conductive substrate and a photosensitive layer in case of a single-layered photoreceptor and to provide the resin layer between a conductive substrate and a charge generating layer in case of a multi-layered photoreceptor so as to solve these problems. For example, a layer formed by coating an alcohol soluble polyamide resin and drying the resin is considered to be effective as the undercoat layer (see, for example, Japanese Unexamined Patent Publication (Kokai) No. 52-25638 and Japanese Examined Patent Publication (Kokoku) No. 63-018185).

Even if such an undercoat layer is provided, although good electrical characteristics and image quality are obtained at the initial stage, the alcohol soluble resin shows a large change in resistance by the environment such as temperature or humidity and thus a potential conspicuously changes with the environmental change, resulting in defects such as black spots, memory and density unevenness on images.

Thus, a photoreceptor having an undercoat layer made of titanium oxide is proposed (see, for example, Japanese Unexamined Patent Publication (Kokai) No. 56-52757). Furthermore, there is also known a technology about a surface treated titanium oxide for the purpose of improving image characteristics or improving dispersibility of titanium oxide in a coating solution for an undercoat layer.

Specifically, Japanese Unexamined Patent Publication (Kokai) No. 2-181158 proposes titanium oxide coated with alumina, and Japanese Unexamined Patent Publication (Kokai) No. 9-152731 proposes coating of titanium oxide with alumina and silica. Also, Japanese Unexamined Patent Publication (Kokai) No. 9-258469, Japanese Unexamined Patent Publication (Kokai) No. 4-229872 and Japanese Unexamined Patent Publication (Kokai) No. 8-328283 propose coating of titanium oxide with a reactive organosilicon compound. Furthermore, Japanese Unexamined Patent Publication (Kokai) No. 2002-236381 proposes coating of titanium oxide with alumina, silica and siloxane.

However, the particle size of titanium oxide has never been optimized with respect to electrical characteristics and image characteristics of a photoreceptor, and particles having a number average primary particle size of 20 to 100 nm were mainly used as ultrafine titanium oxide particles and particles having a number average primary particle size of 0.1 to 1.0 μm were used as a pigment grade titanium oxide.

With the size reduction of a copying machine and a printer, LED has recently been used as exposure light in the formation of a latent image. However, there has been known a specific peculiar image problem such as interference fringe (moire) caused by reflection on the surface of a conductive substrate in the formation of a latent image by LED or laser. Therefore, in the prior art, an undercoat layer containing titanium oxide having average primary particle size of 1 to 20 μm was used so as to prevent the occurrence of the interference fringe.

However, when an organic photoreceptor having an undercoat layer containing titanium oxide having average primary particle size of 1 to 20 μm is used, there arose problems that sensitivity deteriorates during continuous use and fog occurs under high-temperature and high-humidity severe environment.

SUMMARY OF THE INVENTION

An advantage of the present invention is to provide an image forming apparatus using LED as an exposure light source, which can maintain excellent image quality during continuous use even under high-temperature and high-humidity.

The present inventors have intensively studied so as to achieve the above advantage and found the following novel fact. That is, when a multi-layered electrophotographic photoreceptor having a specific undercoat layer is used in combination with exposing means using LED as an exposure light source, image fog does not occur under high temperature and high humidity environment and excellent image quality can be maintained during continuous use under low temperature and low humidity environment.

That is, in the image forming apparatus of the present invention, basically, charging means, exposing means, developing means, transfer means and cleaning means are provided along the direction of movement of an electrostatic image supporting material. The electrostatic image supporting material is a multi-layered photoreceptor comprising a conductive substrate, and at least an undercoat layer, a charge generating layer and a charge transporting layer formed on the conductive substrate in this order. The undercoat layer is made of at least a titanium oxide and a binder resin and has a thickness of 3 μm or less. Fine titanium oxide particles are surface treated with alumina and silica and the number average primary particle size is 20 nm or less. LED is used as an exposure light source in the exposing means.

According to the present invention, since the undercoat layer was allowed to contain titanium oxide having a number average primary particle size of 20 nm or less, which is surface treated with alumina and silica, an electrophotographic photoreceptor having good balance between dispersibility of titanium oxide and electrical insulation properties is obtained. As a result, when this electrophotographic photoreceptor is used in combination with the exposing means by LED exposure, image fog does not occur under high temperature and high humidity environment and excellent image quality can be maintained during continuous use under low temperature and low humidity (L/L) environment.

DESCRIPTION OF PREFERRED EMBODIMENTS

Figure 1:
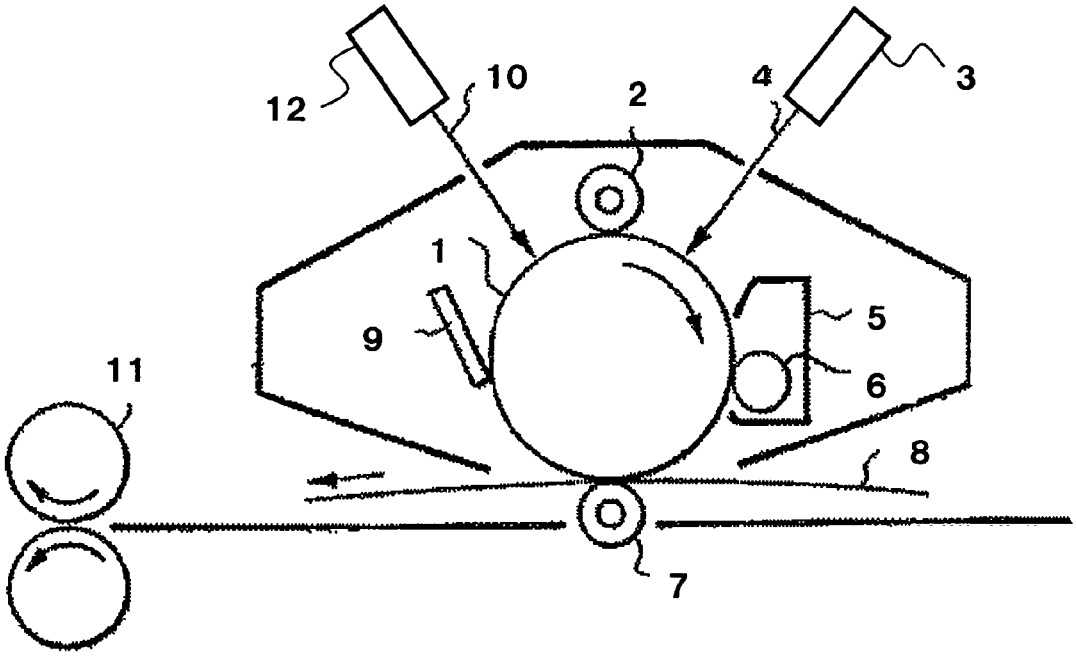
FIG. 1 is a schematic view showing an image forming apparatus according to an embodiment of the present invention.

The image forming apparatus of this embodiment comprises a multi-layered photoreceptor comprising a conductive substrate, and at least an undercoat layer, a charge generating layer and a charge transporting layer formed on the conductive substrate in this order.

(Undercoat Layer)

Preparation of a coating solution used to obtain an undercoat layer is described. The undercoat layer is mainly composed of titanium oxide which is surface treated with alumina and silica, and a binder resin. If necessary, antioxidants, additives and conductant agents may be added. The titanium oxide in the present invention may be titanium oxide, which is obtained by surface-treating titanium oxide obtained by surface-treating with alumina and silica, with an organosilicon compound. The number average primary particle size of the titanium oxide is 20 nm or less.

When LED is used as an exposure light source and a contact charging system is used as the charging means, an undercoat layer containing titanium oxide having a particle size of 1 to 20 μm so as to prevent interference fringe has hitherto been used. However, when an organic photoreceptor having the undercoat layer containing titanium oxide having a particle size of 1 to 20 μm is used, there arose a problem that sensitivity deteriorates during continuous use and image fog occurs under high temperature and high humidity environment. When the exposure light source is laser light, tendency of deterioration of sensitivity conspicuously appears.

When using the very fine titanium oxide particles having a number average primary particle size of 20 nm or less and being surface treated, it is possible to prevent the occurrence of image fog under high temperature and high humidity environment and to maintain excellent image quality during continuous use under low temperature and low humidity environment in case of an image forming apparatus wherein LED is used as an exposure light source and a contact charging system is used for charging.

The titanium oxide to be surface treated with alumina, silica and an organosilicon compound can be prepared by a method using a dry treatment comprising supplying alumina, silica, an organosilicon compound and titanium oxide in a grinding mill while weighing, followed by coating, or a method using a wet treatment comprising adding a solution, which is prepared by dissolving alumina, silica or an organosilicon compound in a suitable solvent, to a titanium oxide slurry, and fully mixing until the solution uniformly adheres, followed by drying. The method using a wet treatment is preferable, thereby making it possible to conduct a uniform surface treatment.

Regarding a surface treatment in the wet treatment, a surface treatment can also be conducted using a wet media dispersion type apparatus. By using the wet media dispersion type apparatus, agglomerated particles can be uniformly dispersed by applying a strong dispersion force, thus making it possible to produce uniform and more fine titanium oxide particles which are surface treated. The wet media dispersion type apparatus is an apparatus including the steps of charging beads as media in a container, and grinding and dispersing agglomerated particles of titanium oxide through high-speed rotation of a stirring disk attached vertically to a rotational axis. The configuration of the apparatus is not specifically limited as long as titanium oxide particles can be sufficiently dispersed and surface treated in case of surface-treating the titanium oxide particles and various types of apparatuses such as vertical, horizontal, continuous and batch type apparatuses can be employed. According to these dispersion type apparatuses, fine grinding and dispersion can be conducted by impact collapse, friction, shear and shearing stress using grinding media (media) such as balls and beads.

As beads in the wet media dispersion type apparatus, for example, beads made of alumina, glass, zircon, zirconia, steel and front stone as a material can be used, and beads made of zirconia and zircon are particularly preferable. The beads preferably have a diameter of about 0.3 to 2.0 mm.

The coating solution can be obtained by dispersing the titanium oxide surface treated with the alumina, silica or organosilicon compound in a binder resin solution. To obtain the coating solution, the titanium oxide treated with the alumina, silica or organosilicon compound may be added to the binder resin solution and then treated using means such as ball mill, sand mill, roll mill, paint shaker, atriter and ultrasonic wave. The undercoat layer is formed by any coating method as long as it is a method capable of coating uniformly to some extent, and coating is commonly conducted using a dip coating method, a spraying method and a nozzle method. The thickness of the undercoat layer is too small, an insufficient effect to local charging failure is exerted. On the other hand, too large thickness can cause an increase in a residual potential or a decrease in an adhesive strength between a conductive substrate and a photosensitive layer. The thickness is preferably 3 μm or less, and more preferably from 0.3 to 3 μm.

(Titanium Oxide)

The fine titanium oxide particles are in the forms of dendrite, needle and granule. Examples of the crystal form of fine titanium oxide particles having these forms include anatase, rutile and amorphous crystal forms. Those having any crystal form may be used and those having two or more crystal forms may be used in combination. Among these, titanium oxide particles having a rutile crystal form are preferable.

The average particle size of fine titanium oxide particles is preferably 20 nm or less, and more preferably 5 nm or more and 10 nm or less in terms of a number average primary particle size. When the number average primary particle size is 20 nm or less, balance between dispersibility of titanium oxide and electrical insulation properties is improved and a bright potential is improved even under L/L (low temperature and low humidity) environment and fog does not occur under H/H (high temperature and high humidity) environment. When the number average primary particle size is more than 20 nm, dispersibility of titanium oxide becomes worse and initial sensitivity becomes worse under L/L environment. Particularly, sensitivity is likely to deteriorate during continuous use under L/L environment.

The number average primary particle size of the fine titanium oxide particles is a measured value obtained by the following procedure. That is, using a transmission electron microscope (magnification: ×10,000), 100 particles are observed as primary particles at random, and then an average diameter in Feret's direction is measured by image analysis.

It is necessary that the fine titanium oxide particles are surface treated with both alumina and silica, and it is preferable that the fine titanium oxide particles are further surface treated with an organosilicon compound.

The titanium oxide used in the present invention and the surface treatment will now be describe in detail. The fine titanium oxide particles of the present invention is surface treated with an inorganic compound such as alumina or silica, and is preferably surface treated with an organosilicon compound.

When the surface treatment with the organic compound is conducted, at least two surface treatment are preferably conducted, for example, first, the surface treatment with the inorganic compound is conducted and then the surface treatment with the organic compound is conducted. The surface treatment with the organic compound means that an organosilicon compound is used as a treating solution.

As the surface treatment with the inorganic compound, a zirconia treatment is used, in addition to an alumina treatment and a silica treatment. These treatments may be used in combination. Also, hydrates of alumina, silica and zirconia are included in alumina, silica and zirconia used in these surface treatments.

As described above, by conducting at least two surface treatments of fine titanium oxide particles with the inorganic compound and the organic compound, the surface of the fine titanium oxide particles is uniformly coated (treated) and, when the surface treated fine titanium oxide particles are used as an undercoat layer, fine titanium oxide particles are satisfactorily dispersed in the undercoat layer and there can be obtained a photoreceptor capable of remarkably suppressing the occurrence of black spots (particularly, under H/H environment) as compared with the case when the surface treatment with the organosilicon compound is not conducted.

As the surface treatment with the inorganic compound, the treatment with alumina and the surface treatment with silica may be conducted simultaneously. However, it is preferable that an alumina treatment is conducted first, and then a silica treatment is conducted. When the treatments with alumina and silica are conducted respectively, the amount of silica is preferably more than that of alumina.

The surface treatments of the fine titanium oxide particles with alumina, silica, and metal oxide such as zirconia can be conducted by a wet method. For example, fine titanium oxide particles surface treated with silica or alumina can be produced in the following manner.

Fine titanium oxide particles (number average primary particle size: 10 nm) are dispersed in water in the concentration of 30 to 300 g/L to obtain an aqueous slurry, and then a water soluble silicate or water soluble aluminum compound is added thereto. After neutralizing by adding an alkali or an acid, silica or alumina is precipitated on the surface of the titanium oxide particles. Subsequently, filtration, washing and drying are conducted to obtain the objective surface treated titanium oxide. When sodium silicate is used as the water soluble silicate, it is possible to neutralize with an acid such as sulfuric acid, nitric acid or hydrochloric acid. On the other hand, when aluminum sulfate is used as the water soluble aluminum compound, it is possible to neutralize with an alkali such as sodium hydroxide or potassium hydroxide.

The amount of the metal oxide used in the surface treatment is preferably within a range from 0.1 to 50 parts by mass, and more preferably from 1 to 20 parts by mass, based on 100 parts by mass of the titanium oxide particles in terms of the amount upon the surface treatment.

Furthermore, the surface treatment with the organosilicon compound, which is conducted after the surface treatment with metal oxide, is preferably conducted by the following wet method.

That is, the titanium oxide treated with the metal oxide is added to a solution prepared by dissolving or suspending the organosilicon compound in an organic solvent or water, and then the resulting solution is stirred for about several minutes to one hour. In some cases, the solution was subjected to a heat treatment, subjected to a filtration process and then dried to obtain titanium oxide particles whose surface are coated with an organosilicon compound. The organosilicon compound may be added to a suspension prepared by dispersing titanium oxide to an organic solvent or water.

The fact that the surface of the fine titanium oxide particles is coated with an organosilicon compound in the present invention is confirmed by a combination of surface analysis techniques such as Auger electron spectroscopy (Auger), photoelectron spectroscopy (ESCA), secondary ion mass spectrometry (SIMS) and diffuse reflection FI-IR, or the measurement of ignition loss.

The amount of the organosilicon compound used in the surface treatment is preferably within a range from 0.1 to 50 parts by mass, and more preferably from 1 to 20 parts by mass, based on 100 parts by mass of the titanium oxide treated with the metal oxide in terms of the amount charged upon the surface treatment. When the amount of the organosilicon compound used in the surface treatment is less than the above range, sufficient effect of the surface treatment is not exerted and dispersibility of the titanium oxide particles in the undercoat layer deteriorates. On the other hand, when the amount is more than the above range, electric performances deteriorate, thereby causing an increase in a residual potential and a decrease in a charge potential.

(Organic Silicon Compound)

An organosilicon compound is at least one organosilicon compound selected from polyorganosiloxanes, alkylsilanes and hydrolysates thereof.

Organopolysiloxanes are commonly referred to as silicone oil, and it is possible to use various ones such as non-reactive silicone oil having no functional group, reactive silicone oil having a functional group, so-called straight type silicone oil which is not modified, and modified silicone oil modified with a higher fatty acid, polyether or alcohol.

Those represented by the following general formula (1) are particularly preferable. In the formula (1), Y represents a methyl group, X1 and X2 represent a hydrogen atom, or the same or different alkyl group or fluoro group, or Y and X1 represent a methyl group, X2 represents a phenyl group, an amino group or an epoxy group, or X1 and X2 represent a methyl group, Y represents a hydroxyl group, an amino group or an epoxy group, and n and m represent an integer.

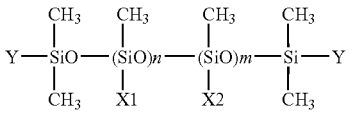

(1)

Examples of organopolysiloxanes include methylhydrogenpolysiloxane, dimethylpolysiloxane, methylphenylpolysiloxane, polydimethylpolysiloxanediol, alkyl-modified silicone oil, alkylaralkyl-modified silicone oil, amino-modified silicone oil, silicone oil modified with an amino group at both ends, epoxy-modified silicone oil, silicone oil modified with an epoxy group at both ends and fluorine-modified silicone oil. Among these organopolysiloxanes, methylhydrogenpolysiloxane, dimethylpolysiloxane and methylphenylpolysiloxane are preferable because they are highly effective.

The polysiloxane compound having a molecular weight of 1,000 to 20,000 is easily available and is also excellent in a function of preventing the occurrence of black spots.

The alkylsilanes are preferably represented by the formula (2). In the formula (2), Y represents an alkyl group, X represents a hydrolyzable group, and n represents an integer of 1 to 3. Provided that alkyl groups of Y may be the same or different when n is 2 or 3. Examples of the compound represented by the formula (2) include n-butyltriethoxysilane, isobutyltrimethoxysilane, n-hexyltrimethoxysilane, n-hexyltriethoxysilane and n-octyltrimethoxysilane.

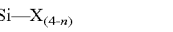

$$Y_n—Si—X_{(4-n)} \quad (2)$$

The number of carbon atoms of the alkyl group (Y in the formula (2)) is preferably 10 or less, and more preferably 6 or less, because thermostability is excellent and discoloration is less likely to occur even when heat treated in the drying and grinding steps after coating titanium dioxide particles.

A hydrolysate of alkylsilanes is preferable because it reacts with a hydroxyl group of titanium dioxide particles on the surface thereby strongly bonding with the titanium dioxide particles.

In the present invention, the hydrolysate refers to silanol obtained by hydrolysis of a hydrolyzable group of alkylsilanes, or a oligomer or polymer having a siloxane bond obtained by polycondensation of silanols, and may contain the unreacted alkylsilanes as long as the object of the present invention is not adversely affected.

The alkylsilanes is not specifically limited as long as the hydrolyzable group (X in the formula (2)) is a halogen group or a hydroxyl group. The hydrolyzable group is preferably an alkoxy group because a secondary product, which is harmful upon hydrolysis, is hardly generated and high stability is secured and the alkoxy group is more preferably a methoxy group or an ethoxy group because of excellent hydrolyzability.

In the formula (2), n is preferably 1 or 2 because there are a lot of reaction sites between the surface of titanium dioxide particles and the hydroxyl group.

(Charge Generating Layer)

A charge generating material used to obtain a charge generating layer will now be described. The charge generating layer can be obtained by mixing a charge generating material and a binder described hereinafter with the other additive and a suitable solvent described hereinafter using a roll mill, a ball mill, an atriter, a paint shaker or an ultrasonic wave disperser to prepare a dispersion solution, and coating the resulting dispersion solution on a conductive substrate using known means, followed by drying. To form the charge generating layer in the present invention, solvents described hereinafter can be used as the solvent and, particularly, a mixture of propylene glycol monoalkyl ether, preferably propylene glycol monomethyl ether, and tetrahydrofuran (also referred to as THF, hereinafter) is used. The proportions of the charge generating material and the binder are not specifically limited, and the amount of the binder to be used is commonly within a range from 5 to 500 parts by weight, and preferably from 20 to 300 parts by weight, based on 100 parts by weight of the charge generating material. The charge generating layer may be a vapor deposited film made of the charge generating material. The thickness of the charge generating layer is preferably adjusted within a range from 0.05 to 5 μm, and more preferably from 0.1 to 2 μm.

Examples of the charge generating material include phthalocyanine-based pigments such as metal-free phthalocyanine, hydroxygalliumphthalocyanine, chlorogalliumphthalocyanine, α-titanylphthalocyanine, Y-titanylphthalocyanine and V-hydroxygalliumphthalocyanine; organic photoconductors such as perylene-based pigment, bisazo pigment, diketopyrrolopyrrole pigment, metal-free naphthalocyanine pigment, metallic naphthalocyanine pigment, squaraine pigment, trisazo pigment, indigo pigment, azulenium pigment, cyanine pigment, pyrylium pigment, anthanthrone pigment, triphenylmethane-based pigment, threne pigment, toluidine-based pigment, pyrazoline-based pigment and quinacridon-based pigment; inorganic photoconductive materials such as selenium, selenium-tellurium, selenium-arsenic, cadmium sulfide and amorphous silicone. Among these charge generating materials, titanylphthalocyanine is particularly preferable. These charge generating materials may be used alone or in combination.

In the present invention, it is preferable to use, as a charge generating material, a phthalocyanine-based pigment, particularly at least one selected from metal-free phthalocyanine (for example, X-type metal-free phthalocyanine), titanylphthalocyanine, hydroxygalliumphthalocyanine and chlorogalliumphthalocyanine in view of electrical characteristics of the photoreceptor when red or infrared light having a wavelength of 650 nm or more such as LED or laser is used as an exposure light source.

(Charge Transporting Layer)

As the charge transporting material in the charge transporting layer, polymer compounds such as polyvinylcarbazole, polyvinylpyrene and polyacenaphthylene, or low molecular compounds such as various pyrazoline derivatives, oxazole derivatives, hydrazone derivatives, stilbene derivatives and arylamine derivatives can be used.

The charge transporting layer can be obtained by mixing the charge transporting material and a binder described hereinafter with the other additives and a suitable solvent described hereinafter using a roll mill, a ball mill, an atriter, a paint shaker or an ultrasonic wave disperser to prepare a dispersion solution, coating the resulting dispersion solution on the charge generating layer using known means, followed by drying. The proportions of the charge transporting material and the binder are not specifically limited. The amount of the hole transporting material to be contained is preferably within a range from 10 to 500 parts by weight, and particularly preferably from 30 to 200 parts by weight, based on 100 parts by weight of the binder resin. When the hole transporting material and the electron transporting material are used in combination, the total amount to be contained is preferably within a range from 10 to 500 parts by weight, and particularly preferably from 30 to 200 parts by weight, based on 100 parts by weight of the binder resin. The thickness of the charge transporting layer is commonly within a range from 10 to 50 μm, and preferably from 15 to 35 μm.

(Binder)

Examples of the binder used in the undercoat layer, charge generating layer or charge transporting layer include polymers and copolymers of vinyl compounds such as styrene, vinyl acetate, vinyl chloride, acrylate ester, methacrylate ester, vinyl alcohol and ethyl vinyl ether; and polyvinyl acetal, polycarbonate, polyester, polyamide, polyurethane, cellulose ether, phenoxy resin, silicon resin and epoxy resin. Preferably the undercoat layer is made of polyamide, the charge generating layer is made of polyvinyl acetal and the charge transporting layer is made of polycarbonate.

(Solvent)

Examples of the solvent used to prepare the dispersion solution include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene; ethers such as dimethylether, diethylether, tetrahydrofuran, dioxane, dioxolane, propylene glycol monomethyl ether, ethylene glycol dimethyl ether and diethylene glycol dimethyl ether; ketones such as acetone, methyl ethyl ketone and cyclohexanone; esters such as ethyl acetate and methyl acetate; dimethylformaldehyde, dimethylformamide and dimethyl sulfoxide. These solvents may be used alone or in combination.

As the solvent of the charge generating material, propylene glycol monoalkyl ether is preferably used. More preferably, propylene glycol monomethyl ether is used in combination with tetrahydrofuran.

As the solvent of the charge transporting material, tetrahydrofuran is preferably used alone. Furthermore, surfactants and leveling agents may be used so as to improve dispersibility of the charge generating material and the charge transporting material as well as smoothness of the surface of the photoreceptor.

(Conductive Substrate)

As the conductive substrate, various materials having conductivity can be used, and examples thereof include metallic simple substances such as aluminum, iron, copper, tin, platinum, silver, vanadium, molybdenum, chromium, cadmium, titanium, nickel, palladium and indium; alloys such as stainless steel and brass; plastic materials obtained by depositing or laminating the above metals; and glasses coated with aluminum iodide, tin oxide and indium oxide.

The conductive substrate is preferably made of a machined aluminum substrate which is not subjected to an alumite (anodizing) treatment. The surface roughness (Ry) of the conductive substrate is preferably from 0.3 to 1.5 μm. This conductive substrate preferably has sufficient mechanical strength. The conductive substrate is used in the form of a drum or sheet according to the structure of the image forming apparatus to be used.

(Image Forming Apparatus)

FIG. 1 is a schematic view showing an image forming apparatus according to an embodiment of the present invention. As shown in FIG. 1, the image forming portion is provided with a photoreceptor drum 1 as the above-described multi-layered electrophotographic photoreceptor. On the periphery of this photoreceptor drum 1, a charging device 2, an exposure device 3, a processor 5, a transfer roller 7 and a cleaning device 9 are provided along the direction of movement of the photoreceptor drum. Also, a fixing roller 11 is provided at the downstream side in a transportation direction of a transfer material 8 such as paper.

To form images, first, the photoreceptor drum 1 is uniformly charged by the charging device 2. As the charging device 2, for example, a non-contact charging device using corotron charge by corona discharge, and a contact charging device using a conductive elastic roller or a conductive brush are used. In the non-contact charging device by corona discharge, since a problem such as generation of corona products such as ozone and NOx arises and the electrical current to the electrophotographic photoreceptor accounts for only 5 to 30% of the entire electrical current and therefore the charging means has poor efficiency, a contact charging device by roller charging is often used.

Then, the photoreceptor drum 1 is irradiated with image exposure light 4 from the exposure device 3 to form latent images on the photoreceptor drum 1. The image exposure light 4 is irradiated based on original images read from the image data inputting portion (not shown) and the resulting latent images are toner developed by a developing roller 6 mounted in a processor 5 to form toner images. The processor 5 consists of a developer such as toner, the developing roller 6, and a feed roller for feeding a toner to the developing roller. As the exposure device 3, a device using LED having a wavelength sensitive to the photoreceptor drum 1, or laser light is commonly used. In a combination with the photoreceptor drum 1 of this embodiment, LED is used. The wavelength of LED is preferably from about 650 to 700 nm.

In synchronism with the formation of the toner images, each one paper is separated and fed from a paper cassette containing the transfer material 8 such as paper, and the toner images formed on the photoreceptor drum 1 are transferred to the transfer material 8 by applying a voltage to a transfer roller 7. Then, the transfer material 8 is transported to a fixing roller 11.

The fixing roller 11 applies heat and pressure to the transfer material 8 passing through the roller, thereby fixing transferred toner images.

Also, pre-exposure light 10 from a cleaning device 9 and a charge neutralizer 12 described hereinafter is used. The charge neutralizer 12 can comprise a conventionally known LED array or fluorescent tube, and preferably has light quantity enough to remove the residual charge on the surface of the photoreceptor drum 1 at a wavelength sensitive to the photoreceptor drum 1.

As the cleaning device 9 for cleaning the residual toner on the photoreceptor drum 1 after transfer those using a fur brush, a magnetic brush or a blade are typical, and blade cleaning is employed in view of accuracy of cleaning and device configuration. The method of abutting a blade on the photoreceptor drum 1 includes a method of a forward system and a method of a counter system, and a blade abutting method of the latter counter system is preferable in view of accuracy of cleaning.

EXAMPLES

The following examples illustrate the manner in which the present invention can be practiced. It is understood, however, that the examples are for the purpose of illustration and the invention is not to be regarded as limited to any of the specific materials or condition therein.

Materials used in Examples are as follows.

(Titanium Oxide)

Regarding the titanium oxide in the present invention, as the titanium oxide which is surface treated with methylhydrogenpolysiloxane after being surface treated with alumina and silica, for example, MT-02 (average primary particle size: 10 nm, manufactured by TAYCA CORPORATION), SMT-02 (average primary particle size: 10 nm, manufactured by TAYCA CORPORATION), SMT-100SAS (average primary particle size: 15 nm, manufactured by TAYCA CORPORATION) and MT-100SAS (average primary particle size: 15 nm, manufactured by TAYCA CORPORATION) were used. As the titanium oxide which is surface treated with alumina and silica, MT-05 (average primary particle size: 10 nm, manufactured by TAYCA CORPORATION) was used.

As the other titanium oxide, for example, STR-100C (average primary particle size: 10 nm, manufactured by SAKAI CHEMICAL INDUSTRY CO., LTD.), STR-100N (average primary particle size: 10 nm, manufactured by SAKAI CHEMICAL INDUSTRY CO., LTD.), MT-100HD (average primary particle size: 15 nm, manufactured by TAYCA CORPORATION), STR-60C (average primary particle size: 20 nm, manufactured by SAKAI CHEMICAL INDUSTRY CO., LTD.), STR-100C-LP (average primary particle size: 20 nm, manufactured by SAKAI CHEMICAL INDUSTRY CO., LTD.), SMT-500SAS (average primary particle size: 35 nm, manufactured by TAYCA CORPORATION), MT-600SA (average primary particle size: 50 nm, manufactured by ISHIHARA SANGYO KAISHA, LTD.) and CR-EL (average primary particle size: 250 nm, manufactured by ISHIHARA SANGYO KAISHA, LTD.) were used.

(Charge Generating Material)

As the charge generating material in the present invention, titanylphthalocyanine was used. The method for preparing the charge generating material will now be described.

In a flask wherein the atmosphere is substituted with argon, 22 g (0.17 mol) of o-phthalonitrile, 25 g (0.073 mol) of titanium tetrabutoxide, 2.28 g (0.038 mol) of urea and 300 g of quinoline were added, followed by heating to 150° C. while stirring. While distilling steam generated from the reaction system, the temperature was raised to 215° C. and the reaction was conducted with stirring for 2 hours while maintaining this reaction temperature.

The reaction was completed and, after cooling to 150° C., the reaction mixture was taken out from the flask. The solid obtained by filtration using a glass filter was washed in turn with N,N-dimethylformamide and methanol and then vacuum dried to obtain 24 g of a bluish violet solid.

10 g of the bluish violet solid obtained in the preparation of the titanylphthalocyanine compound was added in 100 ml of N,N-dimethylformamide, followed by a stirring treatment while stirring through heating to 130° C. for 2 hours. After 2 hours, heating was terminated. After cooling to 23±1° C., stirring was terminated and the solution was subjected to a stabilization treatment by standing in this state for 12 hours. The stabilized solution was filtered using a glass filter and the resulting solid was washed with methanol and then vacuum dried to obtain 9.83 g of a crude crystal of a titanylphthalocyanine compound.

5 g of the crude crystal of titanylphthalocyanine was dissolved in 100 mL of concentrated sulfuric acid. This solution was added dropwise in water under ice cooling, stirred at room temperature for 15 minutes and then recrystallized by standing at about 23±1° C.

The solution was filtered by a glass filter and the resulting solid was washed with water until the wash is neutralized and dispersed in 200 mL of chlorobenzene without drying in the state where water exists, followed by heating to 50° C. and stirring for 10 hours. This solution was filtered by a glass filter and the resulting solid was vacuum dried at 50° C. for 5 hours to obtain 4.1 g of a crystal (blue powder) of titanylphthalocyanine.

It was confirmed that the resulting titanylphthalocyanine has a peak at a Bragg angle 2θ±0.2 of 27.2° and does not show a peak at 7.4° and 26.2° before and after immersed in 1,3-dioxolane or tetrahydrofuran for 7 days, and that one peak was observed at 296° C., other than a peak at about 90° C. attributed to vaporization of adsorption water.

The titanylphthalocyanine is represented by the following formula (3).

(3)

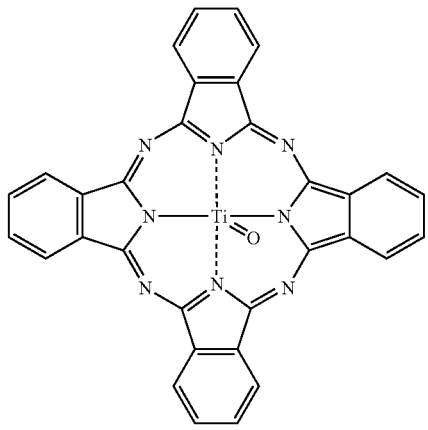

(Charge Transporting Material)

Regarding the charge transporting material, HTM-1 to 6 represented by the following formulas were used as the hole transporting material.

HTM-1
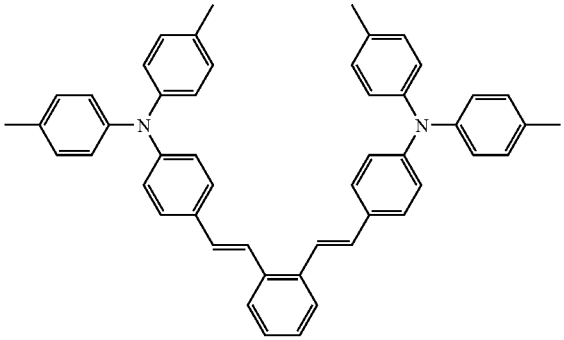
HTM-2
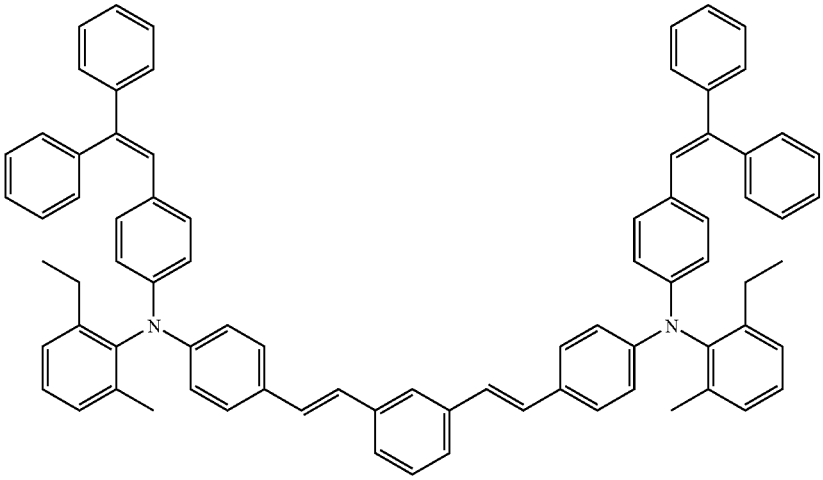
HTM-3
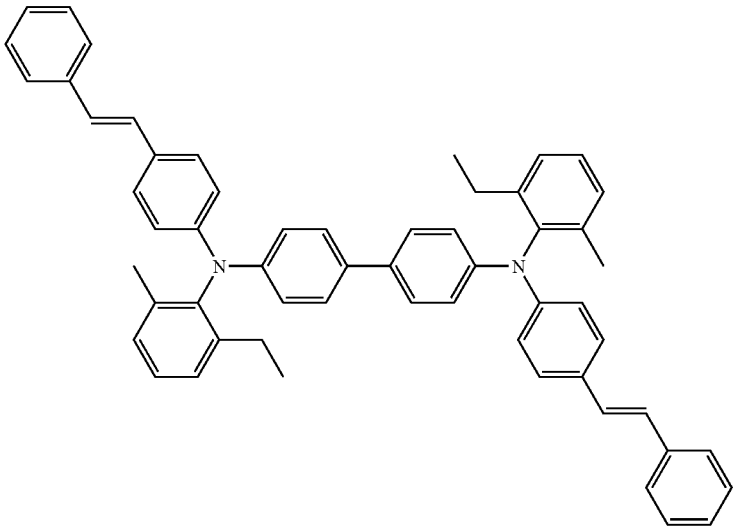
HTM-4
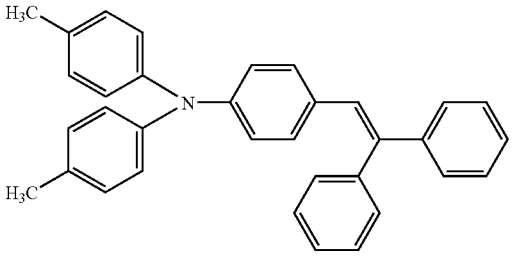
HTM-5
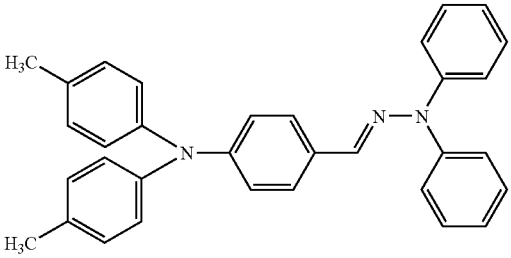

-continued

HTM-6

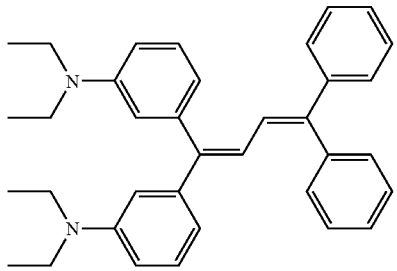

Example 1

Formation of Undercoat Layer 2.2 Parts by mass of titanium oxide MT-02 (number average primary particle size: 10 nm, manufactured by TAYCA CORPORATION) obtained by a surface treatment and 1 part by weight of 6/12/66/610 quadcopolyamide resin (AMILAN CM8000: manufactured by Toray Industries, Inc.) as a binder resin were dispersed in 10 parts by weight of methanol and 2.5 parts by weight of butanol using a paint shaker for 10 hours to prepare a coating solution for an undercoat layer. The titanium oxide used was wet surface treated with alumina and silica in a solvent such as toluene, and then wet surface treated with methylhydrogenpolysiloxane.

The resulting coating solution for an undercoat layer was filtered with a filter having a pore size of 5 μm, coated on an aluminum drum-shaped substrate having a diameter of 30 mm, a full length of 238.5 mm and a surface roughness (Ry) of 1.0 μm as a conductive substrate using a dip coating method, and then heat treated at 130° C. for 30 minutes to obtain a 2 μm thick undercoat layer.

<Formation of Charge Generating Layer>

1 Part by weight of titanylphthalocyanine obtained above as a charge generating material, 1 part by weight of a polyvinyl acetal resin (S-LEC KS-5: manufactured by SEKISUI CHEMICAL CO., LTD.) as a binder resin, 20 parts by weight of tetrahydrofuran as a disperse medium and 60 parts by weight of propylene glycol monomethyl ether were mixed and then dispersed using a ball mill for 48 hours to prepare a coating solution for a charge generating layer. The resulting coating solution was filtered through a filter having a pore size of 3 μm, coated on the undercoat layer formed above using a dip coating method and then dried at 80° C. for 5 minutes to obtain a 0.3 μm thick charge generating layer.

<Formation of Charge Transporting Layer>

70 Parts by weight of stilbene compound (HTM-1) as a hole transporting material, 100 parts by weight of a polycarbonate resin (Resin-1) as a binder resin and 460 parts by weight of tetrahydrofuran as a solvent were mixed and dissolved to prepare a coating solution for a charge transporting layer.

The coating solution for a charge transporting layer thus prepared was coated on the charge generating layer in the same manner as in case of the coating solution for a charge generating layer, and then dried at 130° C. for 30 minutes to form a 20 μm thick charge transporting layer, and thus a multi-layered electrophotographic photoreceptor was produced.

The Resin-1 is represented by the following formula. In the following formula, n is an integer.

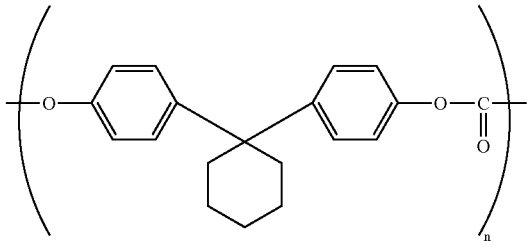

Examples 2 to 14 and Comparative Examples 1 to 21

In the same manner as in Example 1, multi-layered electrophotographic photoreceptors were produced using the conditions and materials shown in Table 1.

As the binder of the undercoat layer, PA100 was used in Example 5 and Comparative Example 20, DAIAMIDE T171 was used in Example 7 and Comparative Example 21, and AMILAN CM8000 was used in other Examples and Comparative Examples.

<Evaluation Test and Evaluation Procedure>

Any one of the photoreceptors produced in Examples 1 to 14 and Comparative Examples 1 to 21 was loaded in a printer manufactured by Oki Electric Industry Co., Ltd. (MICROLINE22: contact charge (only DC), LED exposure, no diselectrification, no cleaning blade, inner diameter of drum element tube: 30 mm, Ry: 0.4 μm, mirror surface cut aluminum tube substrate) and a printer (KONICA7050: scorotron charge, laser exposure, diselectrification, inner diameter of drum element tube: 80 mm, Ry: 0.4 μm, mirror surface cut aluminum tube substrate) manufactured by Konica Corporation, and then images and electrical characteristics of the photoreceptors were evaluated.

Images were evaluated with respect to fog and memory by an output of a blank paper under H/H environment (room temperature of 35° C./relative humidity of 85%). Electrical characteristics were evaluated under L/L environment (room temperature of 10° C./relative humidity of 20%). In the evaluation of images, a black square pattern having 10 mm square was printed only by prescribed number corresponding to one round of the photoreceptor drum, and then entire gray images and entire blank images were printed.

The evaluation was conducted according to the following evaluation criteria. The results are shown in Tale 1. In Table 1, the value of electrical characteristics is an absolute value, $V_0$ is an initial potential, and $V_L$ is a bright potential.

The surface potential of the photoreceptor drum 1 was measured using a surface potentiometer manufactured by MONROE ELECTRONICS.

The image fog was judged by a FD value (number of fog particle per 1000 $\mu m^3$: Fog Density) of the outputted blank images. The evaluation criteria are as follows: the value of 0.0 to 0.005 was rated ◎, the value of 0.005 to 0.01 was rated ○, the value of 0.01 to 0.015 was rated Δ, and the value of 0.015 or more was rated x, respectively.

The FD value was measured using a SpectroEye reflection densitometer manufactured by GretagMacbeth AG.

The memory was judged by visual observation of hysteresis (ghost) of a black square pattern which appears in the outputted gray images.

◎: any ghost is not observed

○: site where ghost appears is observed in slightly high concentration, but pattern of 10 mm square is not observed Δ: ghost is slightly observed, and pattern of 10 mm square can be confirmed x: pattern of 10 mm square is clearly observed Regarding electrical characteristics, the case where a residual potential $V_L$ at the bright potential portion is 75 V or less was rated "Good". The case where a change $\Delta V_L$ in potential at the bright potential portion after printing 2,000 sheets is from −5 to +5 V was rated "Good".

TABLE 1

| | | Titanium oxide | | | | | | Hole | Undercoat layer | | Image |
|---|---|---|---|---|---|---|---|---|---|---|---|
| | | Kind | Particle size | Surface-treating | | | | transporting material | Binder resin | Thickness (μm) | forming apparatus[1)] |
| Examples | 1 | MT-02 | 10 nm | $Al_2O_3$ | $SiO_2$ | MHPS[3)] | Wet | HTM-1 | CM8000[5)] | 2 μm | A |
| | 2 | SMT-02 | 10 nm | $Al_2O_3$ | $SiO_2$ | MHPS | Wet-dispersion[2)] | HTM-1 | CM8000 | 2 μm | A |
| | 3 | MT-05 | 10 nm | $Al_2O_3$ | $SiO_2$ | — | — | HTM-1 | CM8000 | 2 μm | A |
| | 4 | MT-100SAS | 15 nm | $Al_2O_3$ | $SiO_2$ | MHPS | Wet | HTM-1 | CM8000 | 2 μm | A |
| | 5 | SMT-100SAS | 15 nm | $Al_2O_3$ | $SiO_2$ | MHPS | Wet-dispersion | HTM-1 | PA100 | 2 μm | A |
| | 6 | MT-100SAS | 15 nm | $Al_2O_3$ | $SiO_2$ | — | — | HTM-1 | CM8000 | 2 μm | A |
| | 7 | MT-02 | 10 nm | $Al_2O_3$ | $SiO_2$ | MHPS | Wet | HTM-1 | T171[6)] | 2 μm | A |
| | 8 | MT-02 | 10 nm | $Al_2O_3$ | $SiO_2$ | MHPS | Wet | HTM-2 | CM8000 | 2 μm | A |
| | 9 | MT-02 | 10 nm | $Al_2O_3$ | $SiO_2$ | MHPS | Wet | HTM-3 | CM8000 | 2 μm | A |
| | 10 | MT-02 | 10 nm | $Al_2O_3$ | $SiO_2$ | MHPS | Wet | HTM-4 | CM8000 | 2 μm | A |
| | 11 | MT-02 | 10 nm | $Al_2O_3$ | $SiO_2$ | MHPS | Wet | HTM-5 | CM8000 | 2 μm | A |
| | 12 | MT-02 | 10 nm | $Al_2O_3$ | $SiO_2$ | MHPS | Wet | HTM-6 | CM8000 | 2 μm | A |
| | 13 | SMT-02 | 10 nm | $Al_2O_3$ | $SiO_2$ | MHPS | Wet-dispersion | HTM-1 | CM8000 | 1 μm | A |
| | 14 | SMT-02 | 10 nm | $Al_2O_3$ | $SiO_2$ | MHPS | Wet-dispersion | HTM-1 | CM8000 | 3 μm | A |
| Comparative Examples | 1 | STR-100C | 10 nm | $Al_2O_3$ | — | — | — | HTM-1 | CM8000 | 2 μm | A |
| | 2 | STR-60C | 20 nm | $Al_2O_3$ | — | — | Wet | HTM-1 | CM8000 | 2 μm | A |
| | 3 | STR-100C-LP | 20 nm | $Al_2O_3$ | — | DMPS[4)] | Wet | HTM-1 | CM8000 | 2 μm | A |
| | 4 | STR-100N | 10 nm | — | — | — | — | HTM-1 | CM8000 | 2 μm | A |
| | 5 | MT-100HD | 15 nm | $Al_2O_3$ | $ZrO_2$ | — | — | HTM-1 | CM8000 | 2 μm | A |
| | 6 | SMT-500SAS | 35 nm | $Al_2O_3$ | $SiO_2$ | MHPS | Wet-dispersion | HTM-1 | CM8000 | 2 μm | A |
| | 7 | CR-EL | 250 nm | $Al_2O_3$ | — | — | Wet | HTM-1 | CM8000 | 2 μm | A |
| | 8 | MT-600SA | 50 nm | $Al_2O_3$ | $SiO_2$ | MHPS | Wet-dispersion | HTM-1 | CM8000 | 2 μm | A |
| | 9 | SMT-02 | 10 nm | $Al_2O_3$ | $SiO_2$ | MHPS | Wet | HTM-1 | CM8000 | 4 μm | A |
| | 10 | SMT-02 | 10 nm | $Al_2O_3$ | $SiO_2$ | MHPS | Wet | HTM-1 | CM8000 | 5 μm | A |
| | 11 | SMT-500SAS | 35 nm | $Al_2O_3$ | $SiO_2$ | MHPS | Wet-dispersion | HTM-1 | CM8000 | 1 μm | A |
| | 12 | SMT-500SAS | 35 nm | $Al_2O_3$ | $SiO_2$ | MHPS | Wet-dispersion | HTM-1 | CM8000 | 3 μm | A |
| | 13 | SMT-500SAS | 35 nm | $Al_2O_3$ | $SiO_2$ | MHPS | Wet-dispersion | HTM-1 | CM8000 | 4 μm | A |
| | 14 | SMT-500SAS | 35 nm | $Al_2O_3$ | $SiO_2$ | MHPS | Wet-dispersion | HTM-1 | CM8000 | 5 μm | A |
| | 15 | MT-02 | 10 nm | $Al_2O_3$ | $SiO_2$ | MHPS | Wet | HTM-1 | CM8000 | 2 μm | B |
| | 16 | SMT-02 | 10 nm | $Al_2O_3$ | $SiO_2$ | MHPS | Wet-dispersion | HTM-1 | CM8000 | 2 μm | B |
| | 17 | MT-05 | 10 nm | $Al_2O_3$ | $SiO_2$ | — | — | HTM-1 | CM8000 | 2 μm | B |
| | 18 | MT-100SAS | 15 nm | $Al_2O_3$ | $SiO_2$ | MHPS | Wet | HTM-1 | CM8000 | 2 μm | B |
| | 19 | SMT-100SAS | 15 nm | $Al_2O_3$ | $SiO_2$ | MHPS | Wet-dispersion | HTM-1 | PA100 | 2 μm | B |
| | 20 | MT-100SAS | 15 nm | $Al_2O_3$ | $SiO_2$ | — | — | HTM-1 | CM8000 | 2 μm | B |
| | 21 | MT-02 | 10 nm | $Al_2O_3$ | $SiO_2$ | MHPS | Wet | HTM-1 | T171 | 2 μm | B |

| | | Image evaluation | | | Electrical characteristics | | | |
|---|---|---|---|---|---|---|---|---|
| | | | | | | | After printing | |
| | | Fog | Memory | Moire | Initial | | 2,000 sheets | |
| Examples | 1 | ◎ | ◎ | ◎ | 854 | 61 | 59 | −2 |
| | 2 | ◎ | ◎ | ◎ | 847 | 59 | 60 | +1 |
| | 3 | ○ | ◎ | ◎ | 865 | 61 | 60 | −1 |
| | 4 | ◎ | ◎ | ◎ | 854 | 63 | 62 | −1 |
| | 5 | ◎ | ◎ | ◎ | 855 | 61 | 60 | −1 |
| | 6 | ○ | ◎ | ◎ | 859 | 62 | 61 | −1 |
| | 7 | ◎ | ◎ | ◎ | 850 | 60 | 60 | +0 |
| | 8 | ◎ | ◎ | ◎ | 859 | 60 | 59 | −1 |
| | 9 | ◎ | ◎ | ◎ | 861 | 60 | 60 | +0 |
| | 10 | ◎ | ◎ | ◎ | 858 | 62 | 58 | −4 |
| | 11 | ◎ | ◎ | ◎ | 850 | 71 | 72 | +1 |

TABLE 1-continued

| | | | | | | | | |
|---|---|---|---|---|---|---|---|---|
| | 12 | ◎ | ◎ | ◎ | 849 | 71 | 73 | +2 |
| | 13 | ◎ | ◎ | ◎ | 855 | 61 | 62 | +1 |
| | 14 | ◎ | ◎ | ◎ | 842 | 65 | 69 | +4 |
| Comparative Examples | 1 | Δ | ◎ | ◎ | 842 | 70 | 85 | +15 |
| | 2 | ○ | ◎ | ◎ | 862 | 72 | 101 | +29 |
| | 3 | ○ | ◎ | ◎ | 839 | 74 | 88 | +14 |
| | 4 | X | ○ | ◎ | 837 | 71 | 75 | +4 |
| | 5 | Δ | ○ | ◎ | 853 | 60 | 87 | +27 |
| | 6 | ◎ | ◎ | ◎ | 875 | 76 | 86 | +10 |
| | 7 | Δ | ◎ | ◎ | 827 | 69 | 72 | +3 |
| | 8 | ◎ | ◎ | ◎ | 844 | 83 | 95 | +12 |
| | 9 | ◎ | ◎ | ◎ | 842 | 70 | 76 | +6 |
| | 10 | ◎ | ◎ | ◎ | 853 | 76 | 85 | +9 |
| | 11 | ◎ | ◎ | ◎ | 843 | 76 | 82 | +6 |
| | 12 | ◎ | ◎ | ◎ | 839 | 83 | 88 | +5 |
| | 13 | ◎ | ◎ | ◎ | 839 | 82 | 85 | +3 |
| | 14 | ◎ | ◎ | ◎ | 850 | 85 | 92 | +7 |
| | 15 | ◎ | ◎ | X | 650 | 51 | — | — |
| | 16 | ◎ | ◎ | X | 654 | 51 | — | — |
| | 17 | ◎ | ◎ | X | 642 | 49 | — | — |
| | 18 | ◎ | ◎ | Δ | 660 | 61 | — | — |
| | 19 | ◎ | ◎ | Δ | 642 | 50 | — | — |
| | 20 | ○ | ◎ | Δ | 638 | 48 | — | — |
| | 21 | ◎ | ◎ | X | 656 | 52 | — | — |

[1)]A: MICROLINE22, Contact charge (only DC), LED exposure, No diselectrification, No cleaning blade, Drum element tube: 30 mm, Rz: 0.4 μm, Mirror surface cut aluminum tube substrate. B: KONICA7050, Scorotron charge, Laser exposure, Diselectrification, Drum element tube: 80 mm, Ry: 0.4 μm, Mirror surface cut aluminum tube substrate.
[2)]Wet-dispersion: Surface treating of an organosilicon compound while wet-dispersing by zirconia beads.
[3)]MHPS: Methylhydrogenpolysiloxane
[4)]DMPS: Dimethylpolysiloxane
[5)]CM8000: AMILAN CM8000
[6)]T171: DAIAMIDE T171

As is apparent from the results shown in Table 1, when using an image forming apparatus within the scope of the present invention, image fog did not occur under H/H environment and interference fringe (moire) was not generated, and also less change in a potential occurred under L/L environment (stable) and durability was excellent (Examples 1 to 14).

Figure 2:
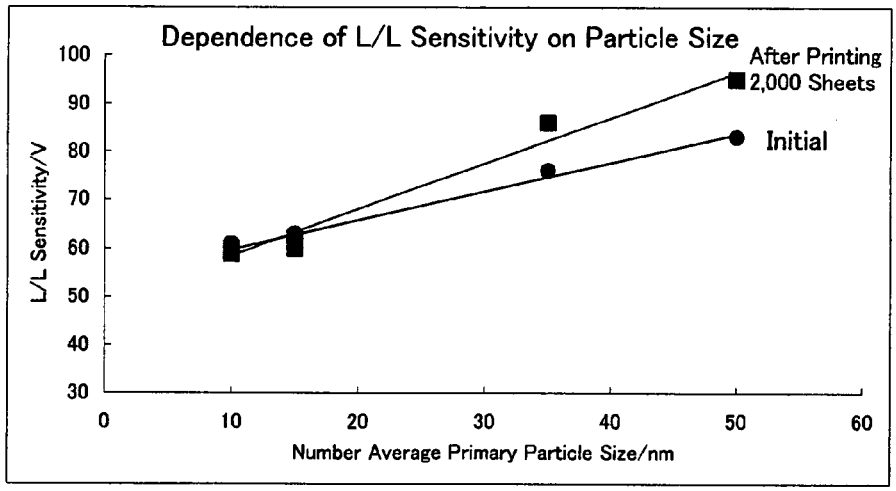
FIG. 2 is a graph showing a relation between the number average primary particle size of titanium oxide of the present invention and sensitivity under L/L environment.

The results are shown in FIG. 2. The particle size of the titanium oxide has a close relation with the change in potential under L/L environment and it is found that as the particle size of the titanium oxide decreases, the sensitivity and change in sensitivity under L/L environment are lowered.

On the other hand, in case of Comparative Examples 1 to 14 wherein the particle size of the titanium oxide or the surface treatment is not within the scope of the present invention and LED was used for exposure, no interference fringe was not observed, but image fog tended to be generated under H/H environment or the potential tended to increase under L/L environment, resulting in poor durability. In case of Comparative Examples 15 to 21 which is within the scope of the present invention, except that laser light was used for exposure, interference fringe was generated and image quality was inferior.

As a result, it was found that the image forming apparatus of the present invention can maintain excellent image quality during continuous printing even under H/H environment and L/L environment.

It is further understood by those skilled in the art that the foregoing description is a preferred embodiment of the disclosed image forming apparatus and that various changes and modifications may be made in the invention without departing from the spirit and scope thereof.

What is claimed is:

1. An image forming apparatus comprising charging means, exposing means, developing means, no diselectrification, transfer means and cleaning means, which are provided along the direction of movement of an electrostatic image supporting material, wherein the electrostatic image supporting material is a multi-layered photoreceptor comprising a conductive substrate, and at least an undercoat layer, a charge generating layer and a charge transporting layer formed on the conductive substrate in this order, the undercoat layer is made of at least a titanium oxide and a binder resin, the undercoat layer has a thickness of 3 μm or less, fine titanium oxide particles are surface treated with alumina and silica, the number average primary particle size is 20 nm or less, and LED is used as an exposure light source in the exposing means.

2. The image forming apparatus according to claim 1, wherein the binder resin in the undercoat layer is an alcohol soluble polyamide resin.

3. The image forming apparatus according to claim 2, wherein the polyamide resin is a copolyamide resin.

4. The image forming apparatus according to claim 1, wherein the titanium oxide has a number average primary particle size of 10 nm or less.

5. The image forming apparatus according to claim 1, wherein the titanium oxide is further surface treated with an organosilicon compound.

6. The image forming apparatus according to claim 1, wherein the charge generating layer is made of titanylphthalocyanine having a peak at a Bragg angle 2θ±0.2 of 27.2°, and a polyvinyl acetal resin.

7. The image forming apparatus according to claim 1, wherein propylene glycol monoalkyl ether is used as a coating solvent used in case of forming the charge generating layer.

8. The image forming apparatus according to claim 1, wherein the conductive substrate is a machined aluminum substrate which is not subjected to an anodizing treatment and has surface roughness (Ry) of 0.3 to 1.5 μm.

9. The image forming apparatus according to claim 2, wherein the conductive substrate is a machined aluminum substrate which is not subjected to an anodizing treatment and has surface roughness (Ry) of 0.3 to 1.5 μm.

10. The image forming apparatus according to claim 3, wherein the conductive substrate is a machined aluminum substrate which is not subjected to an anodizing treatment and has surface roughness (Ry) of 0.3 to 1.5 μm.

11. The image forming apparatus according to claim 4, wherein the conductive substrate is a machined aluminum substrate which is not subjected to an anodizing treatment and has surface roughness (Ry) of 0.3 to 1.5 μm.

12. The image forming apparatus according to claim 5, wherein the conductive substrate is a machined aluminum substrate which is not subjected to an anodizing treatment and has surface roughness (Ry) of 0.3 to 1.5 μm.

13. The image forming apparatus according to claim 6, wherein the conductive substrate is a machined aluminum substrate which is not subjected to an anodizing treatment and has surface roughness (Ry) of 0.3 to 1.5 μm.

14. The image forming apparatus according to claim 7, wherein the conductive substrate is a machined aluminum substrate which is not subjected to an anodizing treatment and has surface roughness (Ry) of 0.3 to 1.5 μm.

* * * * *